US008273000B2

(12) United States Patent
Evans

(10) Patent No.: US 8,273,000 B2
(45) Date of Patent: Sep. 25, 2012

(54) ARTICULATED COORDINATION PUNCHING BAG

(76) Inventor: Brad Leslie Evans, Sierra Madre, CA (US)

( * ) Notice: Subject to any disclaimer, the term of this patent is extended or adjusted under 35 U.S.C. 154(b) by 0 days.

(21) Appl. No.: 12/488,005

(22) Filed: Jun. 19, 2009

(65) Prior Publication Data

US 2009/0318272 A1 Dec. 24, 2009

Related U.S. Application Data

(60) Provisional application No. 61/074,378, filed on Jun. 20, 2008.

(51) Int. Cl.
*A63B 69/20* (2006.01)

(52) U.S. Cl. ..... 482/86; 482/83; 482/87

(58) Field of Classification Search ..... 482/81–90; 273/440.1; 446/336; 473/441–446
See application file for complete search history.

(56) References Cited

U.S. PATENT DOCUMENTS

| | | | | | |
|---|---|---|---|---|---|
| 85,514 | A * | 1/1869 | Cross | 482/82 |
| 932,780 | A * | 8/1909 | Hero | 601/132 |
| 1,267,678 | A * | 5/1918 | Mcardle | 482/89 |
| 1,694,044 | A * | 12/1928 | Thompson | 482/87 |
| 2,223,198 | A * | 11/1940 | Zittrich et al. | 174/127 |
| 2,903,990 | A * | 9/1959 | Brown | 114/219 |
| 3,642,277 | A * | 2/1972 | Gersten | 482/37 |
| 4,077,624 | A * | 3/1978 | Feaser | 482/87 |
| 4,090,705 | A * | 5/1978 | Young | 482/82 |
| 4,201,382 | A * | 5/1980 | Wilson | 482/82 |
| 4,385,759 | A * | 5/1983 | Everroad | 482/82 |
| 4,434,980 | A * | 3/1984 | Babineaux | 482/86 |
| 4,491,315 | A * | 1/1985 | Dye | 482/86 |
| 4,721,302 | A * | 1/1988 | Murphy | 482/89 |
| 5,022,345 | A * | 6/1991 | Bolivar et al. | 119/708 |
| 5,060,936 | A * | 10/1991 | Ekonen et al. | 482/81 |
| 5,643,149 | A * | 7/1997 | Grimaldi et al. | 482/82 |
| 5,656,002 | A * | 8/1997 | Dittmeier | 482/91 |
| 5,769,761 | A * | 6/1998 | Zagata, Jr. | 482/87 |
| 6,234,934 | B1 * | 5/2001 | Gorczyca | 482/50 |
| 6,530,867 | B2 * | 3/2003 | Schwendemann | 482/83 |
| 6,599,199 | B1 * | 7/2003 | Hapshie | 473/56 |
| 6,743,157 | B2 * | 6/2004 | Hackaday | 482/83 |
| 6,827,674 | B1 * | 12/2004 | Ferry | 482/83 |
| 6,887,188 | B1 * | 5/2005 | Davies | 482/82 |
| 7,758,476 | B2 * | 7/2010 | Chu | 482/86 |
| 7,762,214 | B2 * | 7/2010 | Ritchey | 119/707 |
| 8,033,962 | B2 * | 10/2011 | Veitch | 482/81 |
| 2005/0227825 | A1 * | 10/2005 | Kutov | 482/83 |
| 2008/0282993 | A1 * | 11/2008 | Hoehn | 119/712 |
| 2009/0318272 | A1 * | 12/2009 | Evans | 482/86 |
| 2010/0087296 | A1 * | 4/2010 | Hansen | 482/83 |
| 2010/0093502 | A1 * | 4/2010 | Marji | 482/82 |

* cited by examiner

*Primary Examiner* — Glenn Richman
(74) *Attorney, Agent, or Firm* — Larry E. Severin

(57) ABSTRACT

An articulated coordination punching bag includes: a flexible central core; a first target enclosing a first potion of the central core; and a second target enclosing a second potion of the central core. The first and second targets may move independently of each other.

17 Claims, 5 Drawing Sheets

ARTICULATED COORDINATION PUNCHING BAG

RELATED APPLICATIONS

The present application claims benefit of priority to U.S. Provisional Application No. 61/074,378, filed Jun. 20, 2008, which is incorporated herein by reference in its entirety.

BACKGROUND OF THE INVENTION

The present invention generally relates to training devices, and more specifically, to an articulated coordination punching bag.

A heavy punching bag improves only power. Punching bags are predictable because the entire bag moves as a unit. The bag might spin, but it still moves in a simple pattern. When the bag is struck, its movement is very predictable. The bag, being one large cylinder, will move away from the direction of the punch, in a linear pattern, and then swing back in a line in the reverse direction.

As can be seen, there is a need for a punching bag that does not simply move away from the direction of the punch, and then swing directly back.

SUMMARY OF THE INVENTION

In one aspect of the present invention, a device includes: a flexible central core; a first target enclosing a first potion of the central core; and a second target enclosing a second potion of the central core; wherein the first and second targets may move independently of each other.

In another aspect of the present invention a device includes: a flexible central core made of rope; and a plurality of targets, each target enclosing a separate portion of the central core, each target including a generally cylinder-shaped foam portion covered by a sleeve; wherein the device is adapted to be hung so that the targets, when struck, cause the device to move in a generally nonlinear manner.

In another aspect of the present invention a method of training to perform strikes includes: providing a flexible central core; providing a plurality of targets fitted to the central core, the targets having a generally cylinder-shaped foam portion covered by a sleeve; hanging the flexible central core so that the targets are free to move independently of each other; and striking a target.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, an embodiment of the present invention generally provides an articulated coordination punching bag.

Embodiments of the present invention include a coordination punching bag that because of its size, light weight and unpredictable movement, improves both coordination and control of strikes (punches, kicks, etc). Its light weight allows it to be hung in an apartment and used by individuals that could not lift a heavy punching bag. A coordination bag may improve speed, reaction time, coordination and agility. It more accurately simulates a real life opponent.

An embodiment of this device includes a flexible central core, such as a rope. Multiple targets fit over the rope. One or more targets are weighted. The targets are cylinder-shaped foam covered by a protective sleeve. Knots in the rope separate the targets.

An embodiment includes a weight, placed inside one of the cylinders.

The device may be hung from the ceiling. Its light weight promotes control over power when striking. When hit, it moves in a random manner. The movement of the device requires an increase in accuracy and speed, as well as hand eye/body eye coordination, in order to hit it.

Because the bag is light weight and flexible, it can be used as a simulated attack allowing the user to practice blocks, counters, or blocks and counters. In other words, you switch roles with the bag.

In an embodiment, by adding or subtracting weights and sections, the movement can be made more or less predictable, thus providing an adjustability of skill level.

In an embodiment of the invention, the bag has multiple sections, one of them weighted. The bags movement is unpredictable. This causes a need for the strike, punch, kick etc. to have an increased level of speed and accuracy in order to hit the bag.

The figures depict various embodiments of the invention. The embodiments depicted, and other embodiments, may have from two to four or more targets, and the targets each may have zero, one, or more weights. When an embodiment is struck by a person wishing to train to perform strikes (punches, kicks, etc), the device moves in a generally nonlinear manner.

Figure 1:
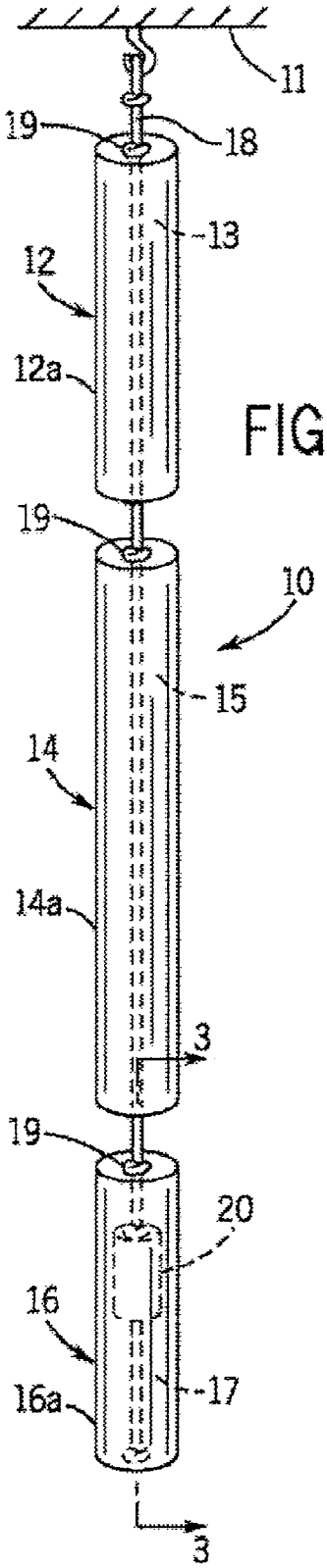
FIG. 1 depicts an embodiment of the present invention with three targets, the lowest target having a weight.

As depicted in FIG. 1, an embodiment of a punching bag 10 includes three targets, each with a foam cylinder and protective sleeve. The bag 10 can be hung from a ceiling 11 by a flexible core made of wire cable or rope 18.

As depicted in the embodiment of FIG. 1, three targets 12, 14, and 16 each enclose a portion of the rope 18. Knots 19 in the rope 18 help prevent the targets 12, 14, 16 from slipping. Upper target 12 includes protective sleeve 12*a* and foam cylinder 13, intermediate target 14 includes protective sleeve 14*a* and foam cylinder 15, and lower target 16 includes protective sleeve 16*a* and foam cylinder 17. The lower target 16 also includes a weight 20, which may be enclose the rope 18 and may be enclosed by the lower target protective sleeve 16*a*.

Figure 2:
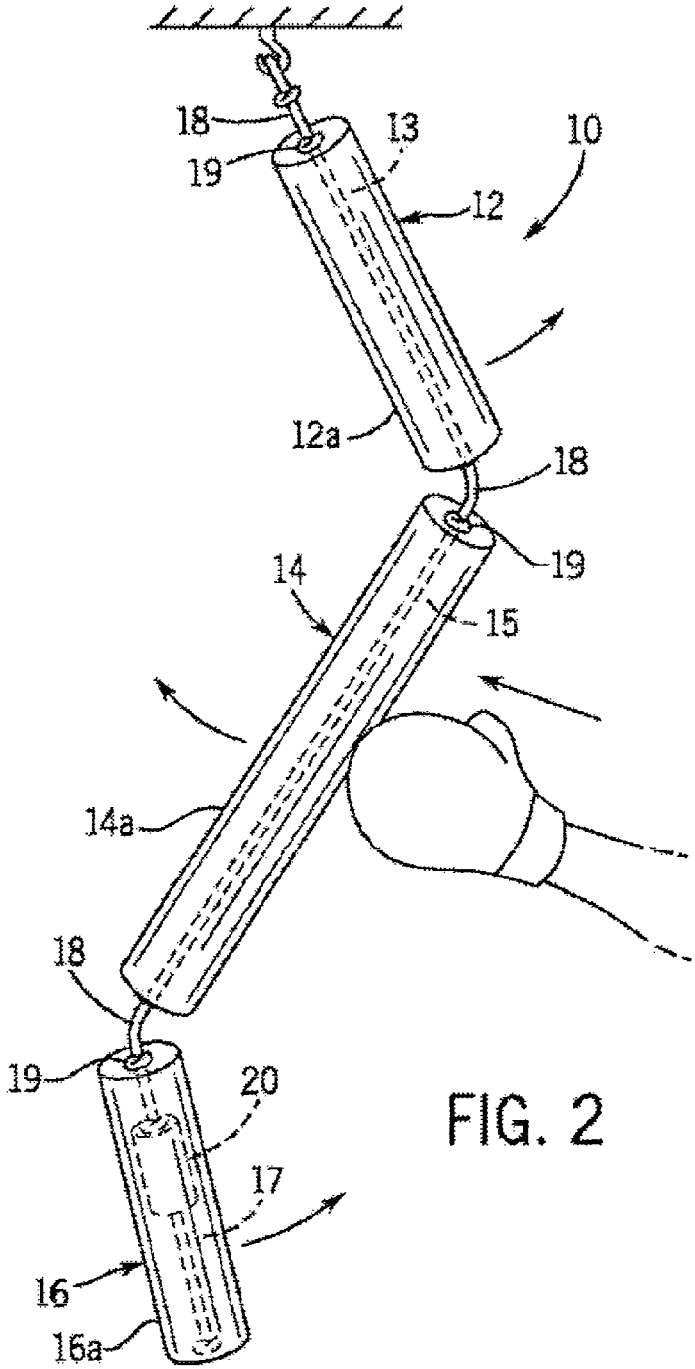
FIG. 2 depicts an embodiment of the present invention in use, with three targets, the lowest target having a weight.

FIG. 2 depicts the embodiment of FIG. 1, in use. The cable 18 allows the targets 12, 14, and 16 to move in an unpredictable, generally non-linear manner, when intermediate target 14 is struck. The weight 20 in lower target 16 further results in unpredictable movement when the targets are struck.

Figure 3:
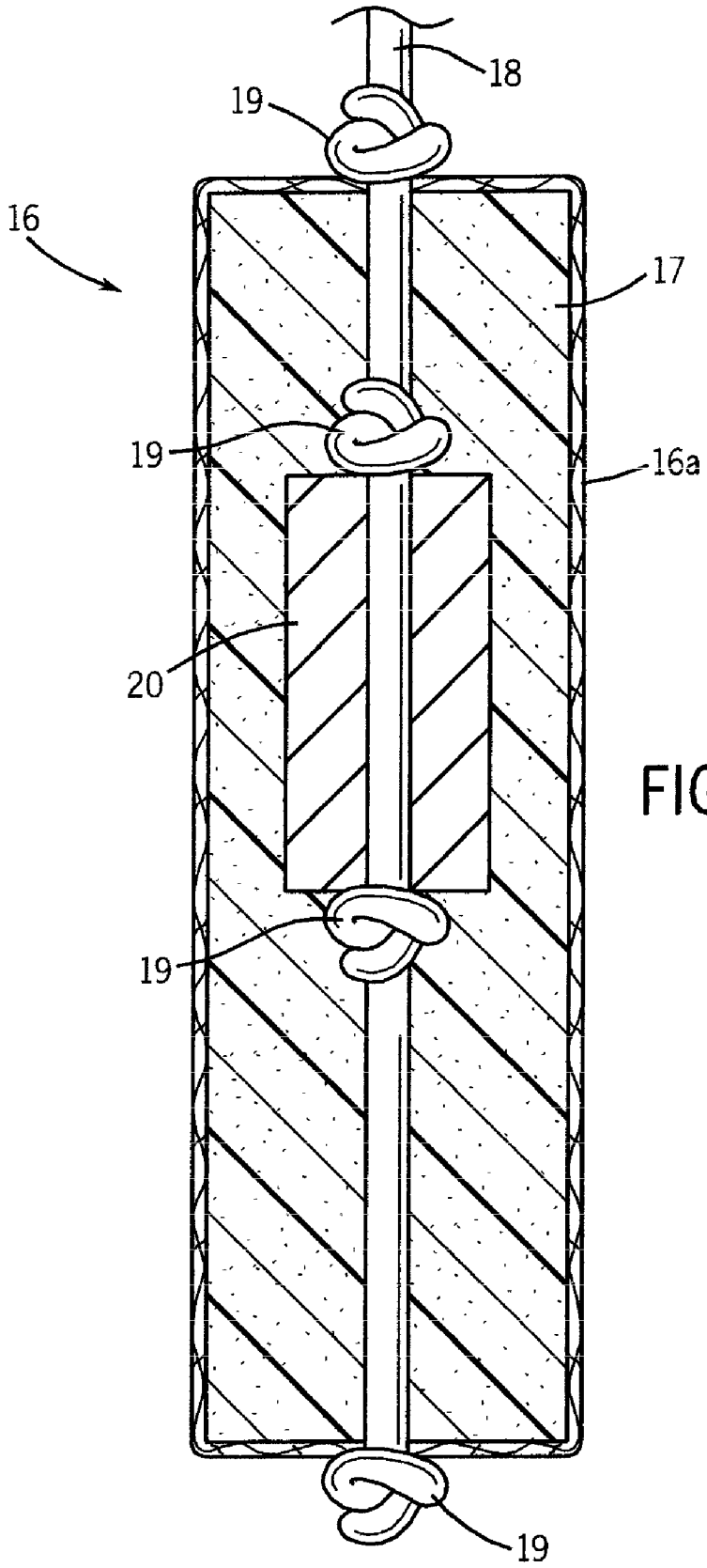
FIG. 3 depicts a cross-sectional view of an embodiment of the lowest target taken on line 3-3 of FIG. 1.

FIG. 3 depicts a cross-sectional view of the embodiment of the lower target 16 taken on line 3-3 of FIG. 1. In addition to knots 19 above and below the target 16, there are knots 19 inside the target 16 to help prevent the weight 20 from slipping. Weight 20 may or may not be enclosed by the foam cylinder 17.

Figure 4:
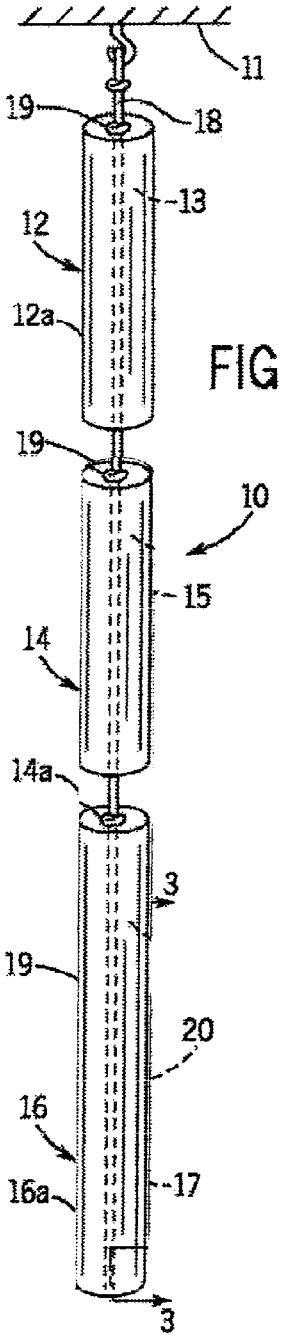
FIG. 4 depicts an embodiment of the present invention with three targets, and no weights.

FIG. 4 depicts an embodiment of the present invention with three targets, and no weights. This embodiment has no weights, and will produce a different type of motion when struck by a user than the embodiment of FIG. 1.

Figure 5:
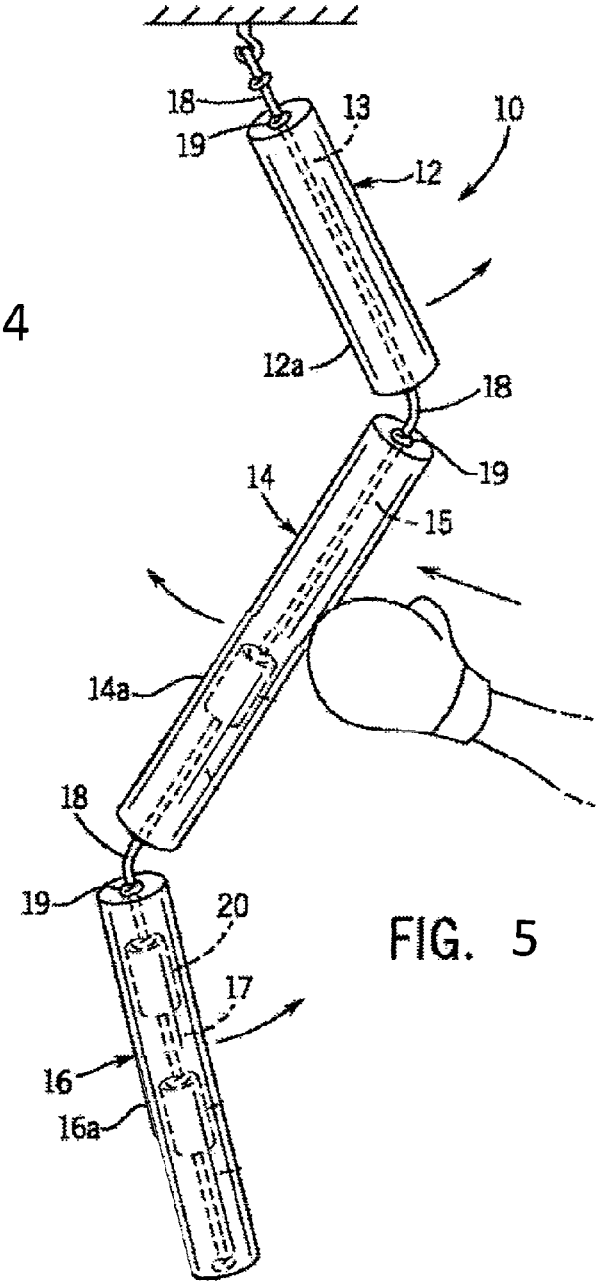
FIG. 5 depicts an embodiment of the present invention in use, with three targets, the middle target having a weight and the lowest target having two weights.
Figure 6:
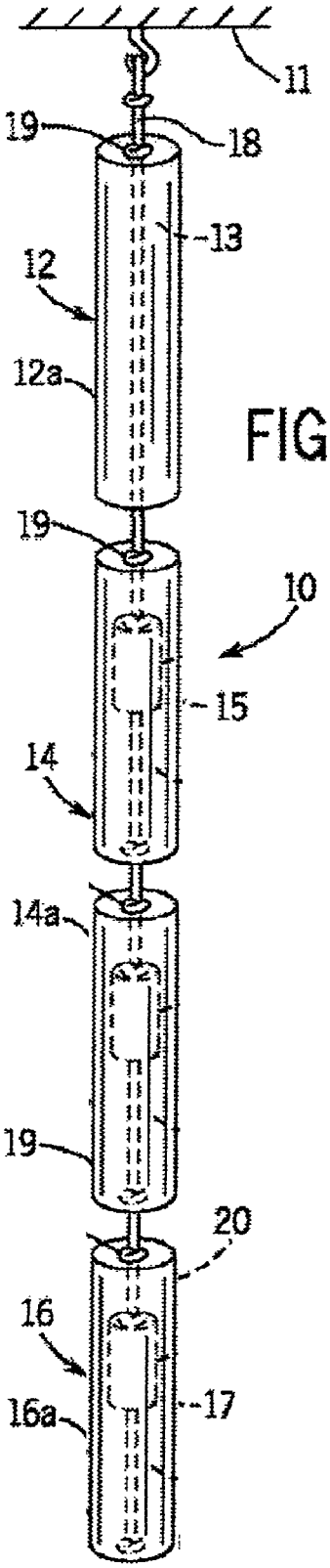
FIG. 6 depicts an embodiment of the present invention with four targets, the lower three targets having weights.
Figure 7:
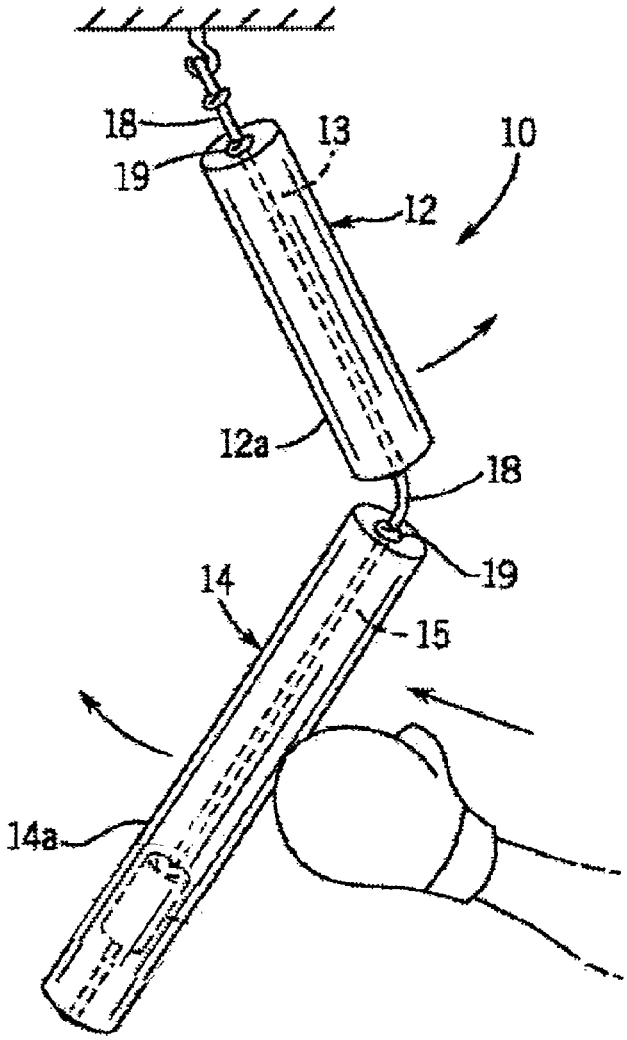
FIG. 7 depicts an embodiment of the present invention in use, with two targets, the lowest target having a weight.
Figure 8:
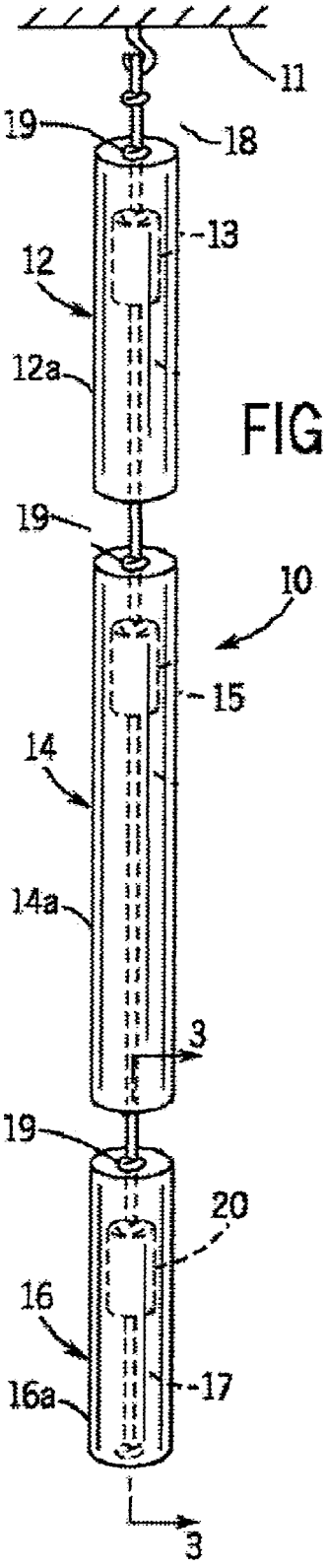
FIG. 8 depicts an embodiment of the present invention with three targets, all having weights.
Figure 9:
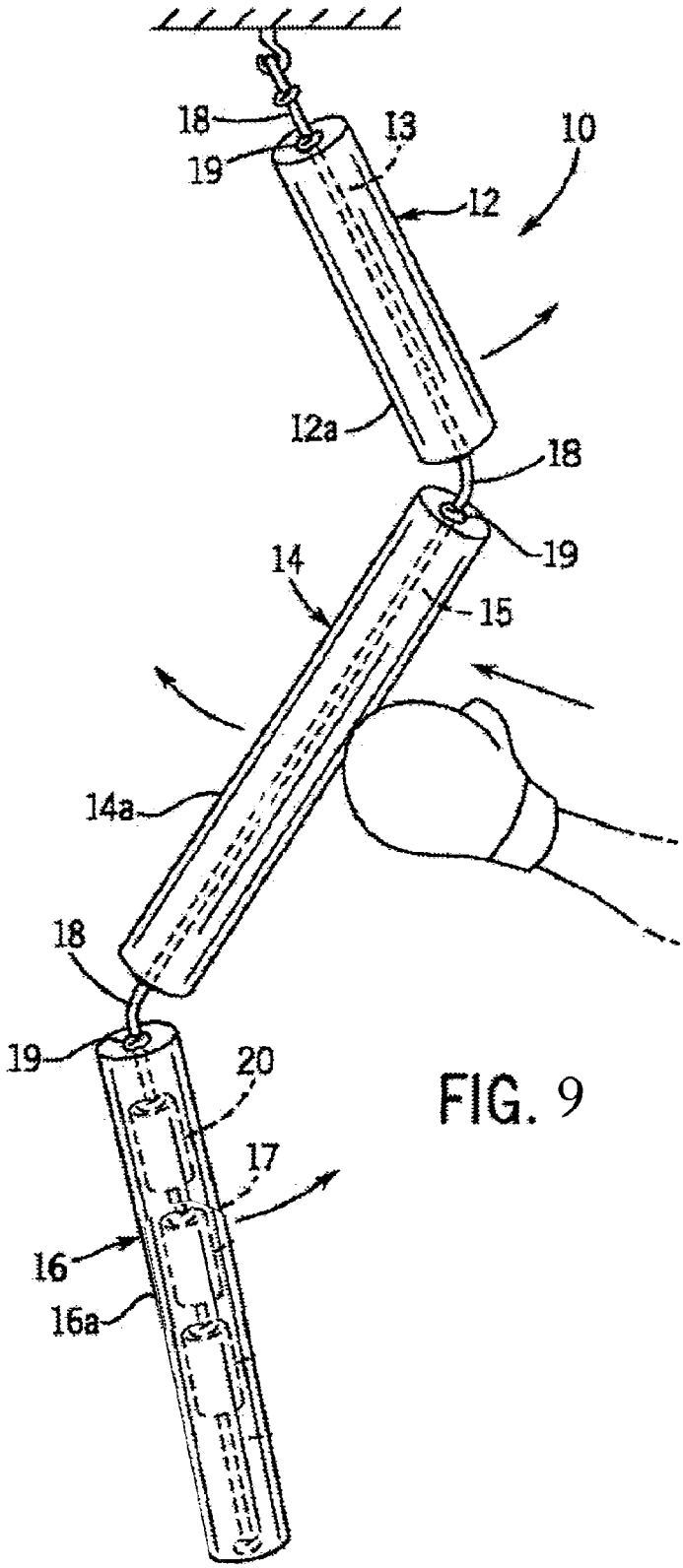
FIG. 9 depicts an embodiment of the present invention in use, with three targets, the lowest target having three weights.

FIG. 5 depicts an embodiment of the present invention in use, with three targets, the middle target having a weight and the lowest target having two weights; FIG. 6 depicts an embodiment of the present invention with four targets, the lower three targets having weights; FIG. 7 depicts an embodiment of the present invention in use, with two targets, the lowest target having a weight; FIG. 8 depicts an embodiment of the present invention with three targets, all having weights; and FIG. 9 depicts an embodiment of the present invention in use, with three targets, the lowest target having three weights. These embodiments will produce different types of motion when the targets are struck by a user.

It should be understood, of course, that the foregoing relates to exemplary embodiments of the invention and that modifications may be made without departing from the spirit and scope of the invention as set forth in the following claims.

I claim:

1. A device comprising:

a flexible central core;

a first, generally cylindrical foam target enclosing a first portion of the central core;

a second, generally cylindrical foam target enclosing a second portion of the central core, there being a difference in weight between the first target and the second target;

a third portion of the central core, between the first and second targets, that provides an articulation between the targets; and one or more weights included in at least one of the targets so that the first target has a different number of weights than the second target;

wherein, when the device is struck, the second target moves relative to the first target in a generally nonlinear manner and the difference in weight causes the device to move unpredictably.

2. The device of claim 1, wherein the third portion of the central core is substantially smaller than the first and second portions so that the articulation is substantially smaller than the targets, thereby providing a punching bag.

3. The device of claim 1, wherein when an end of the core is hung and the device is at rest, the second target hangs on the core below the first target so that the device is generally cylinder-shaped.

4. The device of claim 1, wherein the flexible central core is a wire cable or rope having elements to help prevent the targets from slipping.

5. The device of claim 1 further comprising:

a third generally cylindrical foam target enclosing a fourth portion of the central core, and a fifth portion of the central core, between the second and third targets, the fifth portion providing a second articulation between the second and third targets and where all three targets having different weights.

6. The device of claim 1 wherein the central core is adapted to accept additional targets having differing weights so that adjacent targets weigh different amounts.

7. The device of claim 1, wherein the flexible central core does not substantially extend beyond the bottom of the lowest target so that the lowest portion of the core is enclosed by the lowest target.

8. A device comprising:

a flexible central core made of wire cable or rope; and a plurality of targets, each target enclosing a separate portion of the central core, each target including a generally cylinder-shaped foam portion, there being a difference in weight between at least two of the targets and an articulation in the core between the two targets;

wherein the targets are adapted to accept additional weights so that a user of the device cannot visually determine the relative weight of the targets, and when an end of the core is hung and the device is at rest, the targets hang on the core in a line so that the device is generally cylindrical, and when the device is struck, the targets move in a generally nonlinear and unpredictable manner.

9. The device of claim 8, wherein at least one of the targets includes at least one weight so that at least two of the targets have a different number of weights, thereby providing a difference in weight between at least two of the targets so that the device moves in an unpredictable manner.

10. A device comprising:

a flexible central core, having a top end adapted to be hung and a bottom end opposite the first end;

a first, generally cylindrical foam target enclosing a first portion of the core;

a second generally cylindrical foam target enclosing a second portion of the core, the first and second portions in a line so that the device is generally cylindrical;

an articulation on the core between the first and second targets; and at least one weight enclosed within one of the targets, wherein, when the device is struck, the weight causes the device to move unpredictably.

11. The device of claim 10, wherein the target nearest the bottom end of the core contains the weight.

12. The device of claim 10, wherein the targets are adapted to accept additional weights so that a user of the device cannot predict how the device will move when the targets are struck.

13. The device of claim 10, further comprising a third generally cylindrical foam target enclosing a third portion of the core, the three targets in a line, the first target nearest the top of the core, the second target in the middle, and the third target nearest the bottom of the core, so that when the device is hung and at rest, the device is generally cylindrical.

14. The device of claim 13, wherein the third target contains the weight.

15. The device of claim 13, wherein the second target contains a weight and the third target contains two weights.

16. The device of claim 13, further comprising a fourth target, wherein the second, third, and fourth targets contain weights.

17. The device of claim 13, wherein all three targets contain weights.

* * * * *